US007934454B2

(12) United States Patent
Campo et al.

(10) Patent No.: US 7,934,454 B2
(45) Date of Patent: May 3, 2011

(54) PROJECTILE, PROJECTILE CORE, AND METHOD OF MAKING

(75) Inventors: John E. Campo, Medford, NJ (US); Michael J. Wood, Newman, GA (US)

(73) Assignee: Kee Action Sports I LLC, Sewell, NJ (US)

( * ) Notice: Subject to any disclaimer, the term of this patent is extended or adjusted under 35 U.S.C. 154(b) by 547 days.

(21) Appl. No.: 10/579,002

(22) PCT Filed: Nov. 12, 2004

(86) PCT No.: PCT/US2004/037946

§ 371 (c)(1),
(2), (4) Date: Sep. 27, 2007

(87) PCT Pub. No.: WO2005/104674

PCT Pub. Date: Nov. 10, 2005

(65) Prior Publication Data

US 2008/0163779 A1 Jul. 10, 2008

Related U.S. Application Data

(60) Provisional application No. 60/519,307, filed on Nov. 12, 2003, provisional application No. 60/525,394, filed on Nov. 26, 2003.

(51) Int. Cl.
*F42B 8/00* (2006.01)

(52) U.S. Cl. ..... 102/502; 102/513; 86/54

(58) Field of Classification Search ..... 102/502, 102/513, 511, 512, 498, 444; 86/54
See application file for complete search history.

(56) References Cited

U.S. PATENT DOCUMENTS

| | | | | |
|---|---|---|---|---|
| 2,288,327 | A * | 6/1942 | Scherer | 53/560 |
| 3,861,943 | A | 1/1975 | Grainger | |
| 4,596,392 | A * | 6/1986 | Walker | 473/280 |
| 4,637,616 | A | 1/1987 | Whiting | |
| 4,656,092 | A | 4/1987 | Haman et al. | |
| 4,686,905 | A | 8/1987 | Szabo | |
| 4,886,275 | A * | 12/1989 | Walker | 473/280 |
| 4,921,250 | A | 5/1990 | Ayers | |

(Continued)

FOREIGN PATENT DOCUMENTS

CA 2249563 6/2003

(Continued)

OTHER PUBLICATIONS

Dyrkacz et al., *Some Statistics on Paintballs*, http://home.comcast.net/~dyrgcmn/pball/paintstats.html, Nov. 10, 2004.

(Continued)

*Primary Examiner* — Michelle Clement
(74) *Attorney, Agent, or Firm* — Volpe and Koenig, P.C.

(57) ABSTRACT

A projectile core is provided formed from a carrier and a colorant. The carrier and colorant are mixed into a core mixture, which is formed into a predetermined core shape. The core mixture is cured until substantially firm, such as by drying, heating or freezing. An outer layer may be formed adjacent the surface of the projectile core by heating. An outer coating may also be applied to the projectile core. A method of forming a projectile core comprises: (a) mixing a carrier and a colorant to form a core mixture; (b) forming the core mixture into a predetermined core shape; and, (c) curing the core mixture until a substantially firm projectile core is formed.

21 Claims, 16 Drawing Sheets

U.S. PATENT DOCUMENTS 4,942,818 A * 7/1990 Saxby ..... 102/444
5,001,880 A 3/1991 Smith
5,018,450 A 5/1991 Smith
5,171,592 A 12/1992 Holtzapple et al.
5,246,635 A 9/1993 Ratko et al.
5,254,379 A 10/1993 Kotsiopoulos et al.
5,270,064 A * 12/1993 Shultz ..... 426/90
5,288,772 A 2/1994 Hon
5,303,496 A * 4/1994 Kowalkowski ..... 43/1
5,361,700 A * 11/1994 Carbone ..... 102/439
5,393,054 A 2/1995 Rouffer
5,417,679 A 5/1995 Toms et al.
5,422,160 A 6/1995 Ratko et al.
5,448,951 A 9/1995 Olson
5,450,795 A * 9/1995 Adelman ..... 102/444
5,456,036 A * 10/1995 Butz ..... 43/1
5,519,985 A 5/1996 Dyck et al.
5,529,767 A 6/1996 Brox et al.
5,569,466 A 10/1996 Tanner et al.
5,623,781 A * 4/1997 Legro ..... 47/57.6
5,639,526 A 6/1997 Kotsiopoulos et al.
5,672,300 A 9/1997 Schurig et al.
5,711,795 A * 1/1998 Browning ..... 106/271
5,740,660 A 4/1998 Rowe
5,770,224 A 6/1998 Rashid et al.
5,773,752 A 6/1998 Blume et al.
5,779,968 A 7/1998 Richwine et al.
5,817,323 A 10/1998 Hutchinson et al.
5,885,671 A 3/1999 Bayless et al.
5,896,692 A * 4/1999 Collora et al. ..... 43/1
5,908,636 A 6/1999 Devlin et al.
5,919,481 A 7/1999 Cody et al.
5,921,840 A * 7/1999 Diresta et al. ..... 446/198
5,934,011 A * 8/1999 Ishioka et al. ..... 47/56
5,967,916 A 10/1999 Robeson
6,022,499 A 2/2000 Schurig et al.
6,083,623 A 7/2000 Stofko
6,145,441 A 11/2000 Woodall et al.
6,199,311 B1 * 3/2001 Foster ..... 43/1
6,221,391 B1 4/2001 Rouffer
6,223,658 B1 5/2001 Rosa et al.
6,230,630 B1 5/2001 Gibson et al.
6,248,210 B1 6/2001 Edwards et al.
6,283,037 B1 9/2001 Sclafani
6,337,045 B1 1/2002 Grosswald et al.
6,340,473 B1 1/2002 Tanner et al.
6,352,032 B1 3/2002 Pinney
6,375,981 B1 4/2002 Gilleland et al.
6,387,398 B1 5/2002 Vollhardt et al.
6,393,992 B1 * 5/2002 Vasel et al. ..... 102/502
6,450,100 B1 9/2002 Carson
6,475,500 B2 11/2002 Vatter et al.
6,479,040 B1 11/2002 Barone et al.
6,509,040 B1 1/2003 Murray et al.
6,513,439 B2 2/2003 Brown et al.
6,530,962 B1 3/2003 Stolz
6,532,947 B1 3/2003 Rosa et al.
6,543,365 B1 * 4/2003 Vasel et al. ..... 102/502
6,569,363 B1 5/2003 Schurig et al.
6,574,945 B2 6/2003 Martinez, Jr.
6,589,536 B1 7/2003 Brox et al.
6,604,946 B2 8/2003 Oakes
6,615,739 B2 9/2003 Gibson et al.
6,634,523 B2 10/2003 Slewidge
6,661,563 B2 12/2003 Hayashi et al.
6,675,789 B2 1/2004 Pearce, III et al.
6,729,867 B2 5/2004 Peter et al.
6,759,395 B2 7/2004 Rao et al.
6,772,694 B1 8/2004 Pearce, III et al.
6,805,818 B2 10/2004 Schurig et al.
6,949,256 B2 9/2005 Fonkwe et al.
7,017,497 B1 * 3/2006 Gardner, Jr. ..... 102/513
7,040,308 B2 5/2006 Ciesiun
7,096,793 B2 8/2006 Belog
7,134,978 B2 11/2006 Liu et al.
7,194,960 B2 3/2007 Vasel et al.
7,195,777 B2 3/2007 Stevens et al.
2001/0038160 A1 * 11/2001 Peter et al. ..... 264/163
2002/0046486 A1 4/2002 Wild et al.
2002/0129728 A1 9/2002 Vasel et al.
2002/0134055 A1 * 9/2002 Martinez, Jr. ..... 53/454
2002/0134274 A1 * 9/2002 Martinez et al. ..... 102/513
2003/0127760 A1 7/2003 Schurig et al.
2003/0230296 A1 12/2003 Farrell
2005/0155513 A1 7/2005 Belog
2005/0191346 A1 9/2005 Nowak et al.
2006/0029660 A1 2/2006 Fonkwe et al.
2006/0141026 A1 6/2006 Perron
2006/0205546 A1 9/2006 Liu et al.
2006/0230999 A1 10/2006 Long
2007/0054762 A1 3/2007 Tocco
2007/0095240 A1 5/2007 Perrone
2007/0148380 A1 6/2007 Black
2007/0193914 A1 8/2007 Scarabino
2007/0240601 A1 * 10/2007 Chou et al. ..... 102/502
2007/0245919 A1 10/2007 Vasel et al.
2008/0035006 A1 2/2008 Ciesiun et al.
2008/0103262 A1 5/2008 Haschke
2008/0134927 A1 6/2008 Skellern

FOREIGN PATENT DOCUMENTS

EP 455742 3/1995
EP 576848 8/1995
EP 653979 4/1997
EP 889828 1/1999
EP 1009358 10/2002
EP 1028058 8/2003
WO 99-41448 8/1999
WO 00-53999 9/2000
WO 01-16423 3/2001
WO 01-64421 9/2001
WO 02-03778 1/2002
WO WO 03002480 A1 * 1/2003
WO 03-018905 3/2003
WO 03-085224 10/2003

OTHER PUBLICATIONS

Summers et al., *Yields and property variations for rice straw in California*, University of California.
BC International Corp., *BCI'S Projects* , http://www.bcintlcorp.com/projectsprint.html, Nov. 9, 2004.
*Annex*, http://www.fao.org/DOCREP/003/X8054E/x8054e09.html, Nov. 9, 2004.
Paintball Tips & Tricks!, http://www.paintball-tips-and-tricks.com/paintballs.html, Nov. 9, 2004.
Vogler, *Understanding Wood Wastes as Fuel* , http://sleekfreak.ath.cx:81/3wdev/VITAHTML/SUBLEV/EN1/WO, Nov. 9, 2004.
*Hollow Blocks From Rice Hulls* , http://www.stii.dost.gov.ph/tekno/book1/book1_85.html, Nov. 9, 2004.
George et al., *Bioconversion of rice straw into improved fodder for cattle* , http://www.unu.educ/unupress/unupbooks/80362e/80362E05.html, Nov. 9, 2004.
*Executive Summary* , http://www.westbioenergy.org/ricestraw/exsum.html, Nov. 9, 2004.

* cited by examiner

PROJECTILE, PROJECTILE CORE, AND METHOD OF MAKING

FIELD OF THE INVENTION

The present invention is directed to an improved marking projectile core, a marking projectile and method of making same.

BACKGROUND

In recent years, the popularity of the combat game known as "Paintball" has increased dramatically. Paintball is now a recognized and popular sporting activity. In one form of this game, players on two teams are each supplied with a paintball marker (paintball gun) and a number of marking projectiles, or "paintballs," which are rounds of ammunition. The terms "projectile" and "marking projectile" are used interchangeably. The projectiles comprise a spherical gelatin or starch shell filled with a non-toxic, water-soluble, biodegradable paint (referred to herein "liquid dye"). Paintball markers fire these paintballs using compressed gas (e.g. C02, N2, etc.) as a propellant. When a player is hit with a paintball, the paintball ruptures, "painting" or "marking" the target providing dramatic evidence of the hit, without injuring the player.

Soft and hard capsules, shells or casings have been used in the sports and leisure fields, as well as in law enforcement and military training, with liquid dye formulations within projectiles adapted to rupture upon impact with an intended target. Generally, such projectiles have the physical properties in which the casing is hard and impact resistant enough to survive normal loading and firing forces, while at the same time adapted to rupture and release the liquid dye composition upon high velocity contact with a target surface. Thus, known marking projectiles are essentially a capsule or shell filled with a liquid. The capsule or shell defines the shape of the projectile, and the fill material, which is a liquid or semi-solid, is shapeless or amorphous, and moves within the capsule or shell.

Some currently available liquid dye compositions used in paint balls contain a dye in conjunction with hydrophilic carriers containing a mixture of high and low molecular weight polyethylene glycols (PEG). Among the disadvantages associated with currently available dye compositions include tenacious or permanent staining of target fabrics, freezing and solidification of the dye composition during exposure to colder temperatures, separation and precipitation of dye composition ingredients during storage, and a thin consistency. Various liquid dyes are discussed in U.S. Pat. No. 6,530,962, which is incorporated by reference.

A marking projectile impacts a target at a high velocity, which produces an impact force upon the projectile. Projectiles are formed so that the shells do not rupture until a sufficient impact force is imparted.

Currently available projectiles formed from gelatin or starch shells and filled with marking liquid dye suffer various deficiencies, both in manufacture, and in use. These types of paintballs are expensive to manufacture, and may suffer breakage problems. Known projectile filled with liquid dye also suffer from accuracy problems, as the liquid dye tends to shift during flight.

While gelatin capsule or starch shell production may be expensive and time consuming, there currently exists an abundance of agricultural biomass, which may be defined as the biodegradable fraction of products, waste and residues from agriculture, or as plant material processing waste. Various types of biomass are discussed in U.S. Pat. No. 5,171,592, which is incorporated herein by reference. In particular, there is an abundance of cellulosic fibrous material produced as a waste byproduct of agriculture. For example, rice straw is produced throughout the world as a byproduct of rice cultivation. The options for the disposition of rice straw are limited by the great bulk of material, slow degradation in the soil, harboring of rice stem diseases, and high mineral content. Fields must be cleared of rice straw to make way for the next crop. Accordingly, alternate uses are sought for rice straw and other biomass.

Many pigments, powders, emulsifiers and binders are also freely available and inexpensive, and used in many industries. Powders are useful for their absorbent properties and their compactibility, and pigments are useful for their colorant properties.

There exists a need for improved technology relating to marking projectiles.

In particular, there is a need to improve the attributes of projectiles, by providing a projectile that is efficient to manufacture, low cost, and safe to the environment.

There is yet a further need for a projectile that is formed other than as a liquid filled capsule.

In addition, there exists the need for a paintball formed from freely available materials that may be acquired and processed at low cost.

SUMMARY OF THE INVENTION

The present invention is directed to a novel projectile core, a projectile having the novel core of the present invention, and a method of making the same.

A projectile core according to the present invention generally comprises a carrier mixed with a colorant, formed into a predetermined projectile core shape. The projectile core is substantially firm, and retains its shape prior to impact with a target. Upon impact with a target, the projectile core at least partially disintegrates or disperses, marking the target with the color of the colorant. In a preferred embodiment, the carrier is a fibrous, absorbent material, such material capable of absorbing liquid dye. The projectile core of the present invention can then be coated or sealed to form a projectile of the present invention.

In another embodiment of the present invention, the carrier is a powder. The powder is blended with a colorant, and formed into a predetermined projectile shape.

An outer coating may be applied to the projectile core, forming the outer coating, and finishing the projectile. The outer coating may be applied by any acceptable method, including, but not limited to spraying, vat immersion, etc.

DETAILED DESCRIPTION OF THE PREFERRED EMBODIMENT(S)

Figure 1:
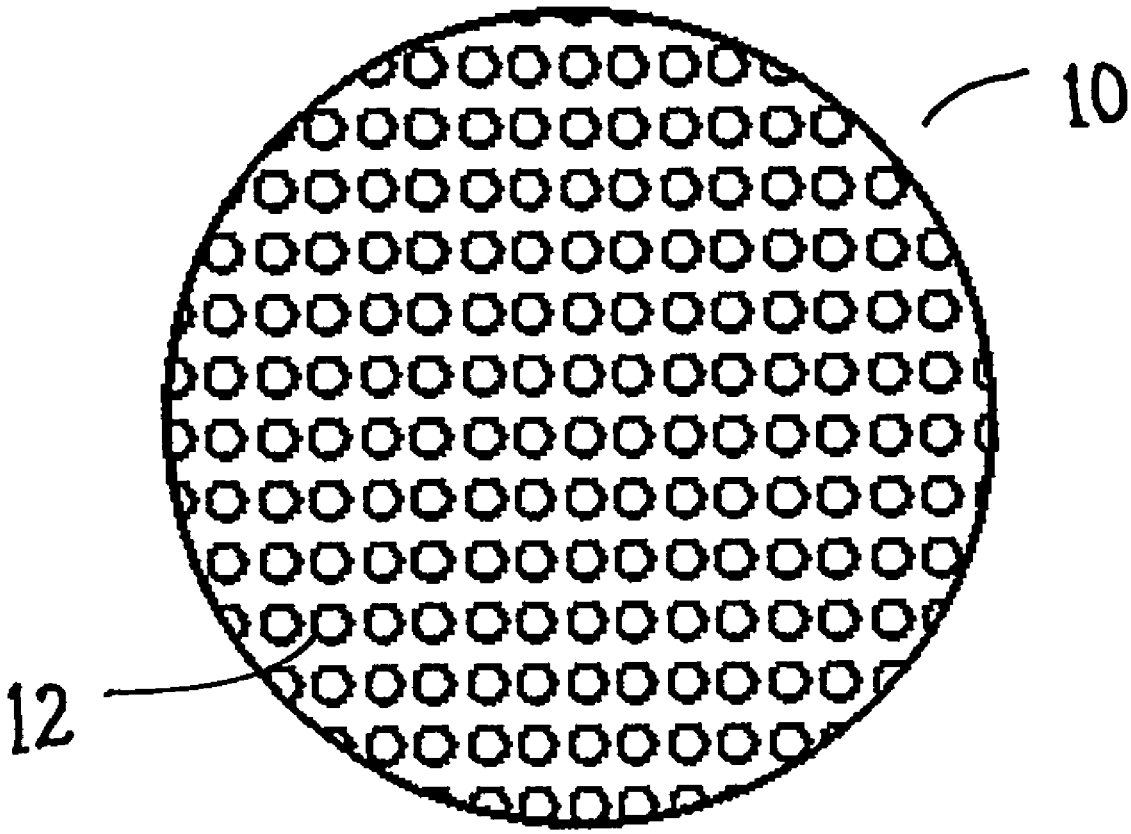
FIG. 1 is a diagrammatic cross sectional view of a projectile core of the present invention.
Figure 2:
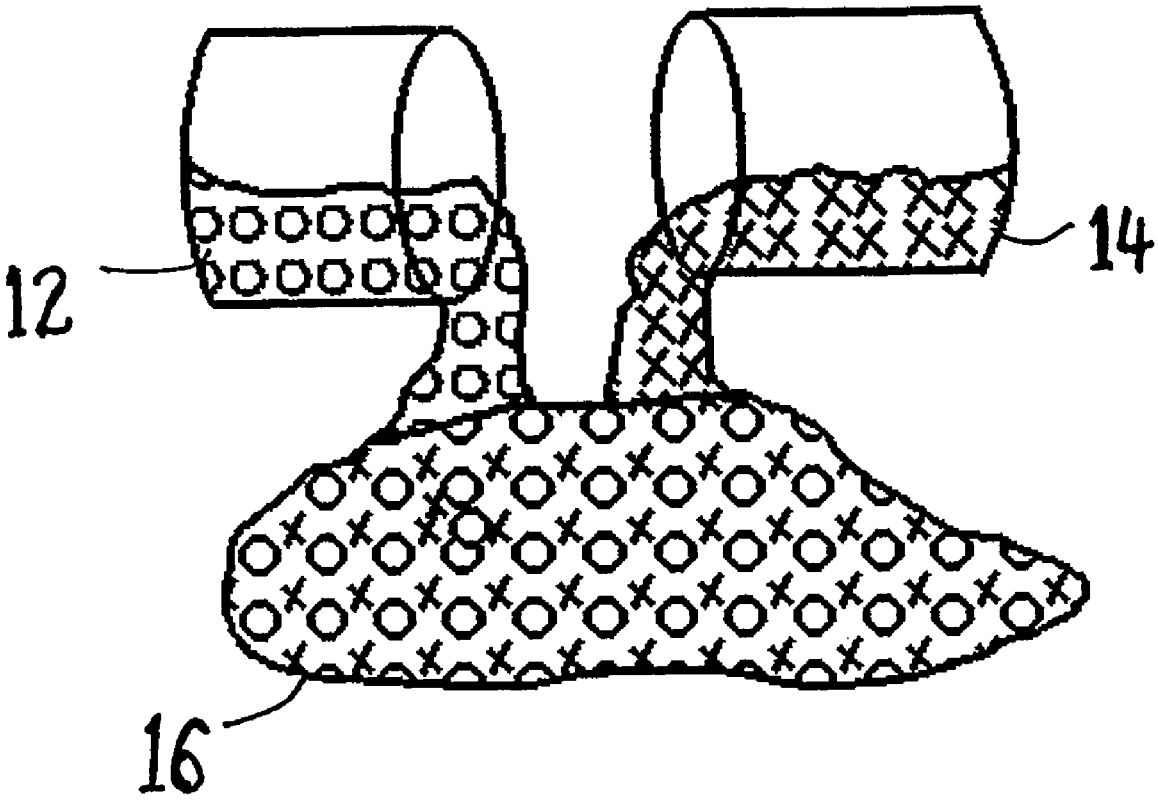
FIG. 2 is a diagrammatic representation of the combination of materials to form a mixture used in a core of the present invention.

Referring to the figures wherein like elements are represented by like numerals, FIG. 1 depicts a projectile core 10, having a carrier 12. In a preferred embodiment, the carrier comprises an absorbent material. The absorbent material is preferably a fibrous, absorbent material, such as a cellulosic material, or an absorbent powder, each of which is discussed in detail below. The projectile core 10 further comprises a colorant 14 for marking a target. As shown by FIG. 2, the carrier 12 and colorant 14 are mixed or otherwise blended to form a core mixture 16.

A novel aspect of the projectile core 10 of the present invention, is that the carrier 12 or core mixture 16 is shaped into a predetermined core shape prior to coating or sealing. As used herein, the predetermined core shape refers to the overall shape of the projectile core 10. The predetermined core shape is formed prior to any optional coating or sealing of the projectile core 10. The projectile core 10, once formed into the predetermined core shape, is at least partially cured, either with ambient air, heat, or cold, until it is substantially firm. As used herein, the term "substantially firm" is used to designate a state whereby the projectile core 10 generally retains its predetermined core shape prior to impact with a target. The predetermined core shape is not defined by, or otherwise a function of, any outer coating, capsule, or shell. The projectile core 10 of the present invention may be adapted to support a coating, wherein the coating conforms to the predetermined core shape. The predetermined core shape is preferably a sphere, such as for use in the sport of paintball. Upon impact, at least a portion of the projectile core 10 disperses or disintegrates, marking the color of the selected colorant 14 on the target.

Fibrous, Absorbent Material

In one embodiment, the carrier 12 is a cellulosic material, capable of absorbing a colorant 14. The colorant 14 may be a pigment, a liquid dye, a powder dye, a water soluble dye, a permanent dye, an infra red dye, an ultra violet dye, a "disappearing" ink or dye that initially marks and fades over a period of time, or a dye that glows in the dark, and any equivalents or substitutes. The combination of the carrier 12 and the colorant 14 is referred to herein as the core mixture 16. The carrier 12 or core mixture 16 is formed into a predetermined core shape forming a projectile core, which preferably has a spherical shape, and is sized and weighted for use as a marking projectile. As used herein, the term "marking projectile" or "projectile" are used interchangeably, and describe a projectile which at least partially disintegrates or disperses and marks a target upon impact, being useful in the sport of paintball, as well as by military or law enforcement training.

The projectile core 10 comprises a colorant 14 for marking a target. The colorant 14 in a paintball, by way of example, is a liquid dye that is non-toxic and non-caustic, water-soluble and usually formed from biodegradable or naturally-occurring ingredients. Colorant 14, as used herein, refers to any of the known liquid dyes, such as food colorings, or other water-soluble, non-toxic marking liquids, sometimes referred to as "paint," used in the sport of paintball, or in, connection with non-lethal rupturable marking projectiles such as those used by law enforcement such as, for example, training. Food dyes (pigments) and polyethylene glycol, may be used. The liquid dye may also be a mixture of propylene glycol, sorbitol, color dye and wax.

Certain cellulosic material is recovered as agricultural waste, which can also be termed biomass. As used herein, the terms "cellulosic material" and "cellulosic materials" refer to any of the fibrous materials containing cellulose, including materials characterized as lignocellulose or hemicellulose. The cellulosic material can be any suitable fibrous substance or substances that will absorb the colorant 14. For example, typical cellulosic materials for use in the present invention include, but are not limited to, agricultural fiber such as rice straw, wheat straw, or combinations thereof. Cellulosic materials include the biomass of aspen chips, sawmill and logging residues, wheat straw, wheat chaff, barley straw, rice straw, corn stover, sugarcane bagasse, kochia stems, and the like. However, no specific source of cellulosic material is required. Preferably, the cellulosic material absorbs a liquid dye.

There are a variety of nonwood plants which produce fibers having absorbent properties. These nonwood plants are often referred to in the art as "agricultural residues" or "fiber crops". Examples of plants for each of these categories include agricultural residues fiber crops including: wheat straw, kenaf, rice straw, industrial hemp, corn stalks, sisal bagasse (sugar cane), textile flax straw, rye grass, straw, Hesperaloe, seed flax, straw flax, and straw.

The cellulosic material usable for the present invention may be a lignocellulose material selected from plant fiber materials including wood pieces, wood meals, wood fibers, wood chips, veneer scraps, plywood scraps, waste-paper, pulps, rice straw, rice hulls, kaoliang straw, bagasse, bamboo, and wheat straw.

The preferred cellulosic material is rice straw. Rice straw is a fibrous composition, capable of absorbing liquid such as the liquid dye necessary for use in the sport of paintball. Rice straw is resistant to bacterial decomposition and therefore suitable to serve as a projectile core, which will be stored and may not be used immediately.

Other cellulosic materials may be used for the carrier 12 as an alternative to rice straw, including but not limited to straws, grasses, palm waste, wheat straw, plant waste or paper mill waste, corn stover, kenaf, industrial hemp, sisal, rye grass straw, wheat straw, bagasse, hesperaloe, flax straw, non-woody fibers liberated from sugar cane, bagasse, sabai grass, banana leaves, paper mulberry (i.e., bast fiber), abaca leaves, pineapple leaves, esparto grass leaves.

Lignocellulose refers to plant materials made up primarily of lignin, cellulose, and hemicellulose. Examples of suitable materials are wood, wood flour, wheat straw, rice straw, corn straw, hemp, dried grass, rice hulls, bagasse, flax, stalks of other plants such as soya, cotton including recycled and shredded cotton fabrics, shredded regenerated cellulose fibers and fabrics such as rayon, shredded paper, etc. Also, recycled fibers which may contain any of the above cellulosic materials in different percentages can be used in the present invention.

All of the above materials are referred to herein, individually or in combination, as "cellulosic material" or "cellulosic materials." As used herein, the terms "carrier" includes any of the above-listed cellulosic materials or combinations thereof, as well as any other fibrous, absorbent materials having properties desirous for the formation of a projectile core as described herein. Rice straw is used as the primary example of a cellulosic material used for the carrier. In one embodiment, the projectile core of the present invention is formed from materials that are capable of carbonizing, such as by heating or partial burning. Those materials which carbonize and thicken when exposed to heat are preferred, as described in greater detail below.

Figure 3:
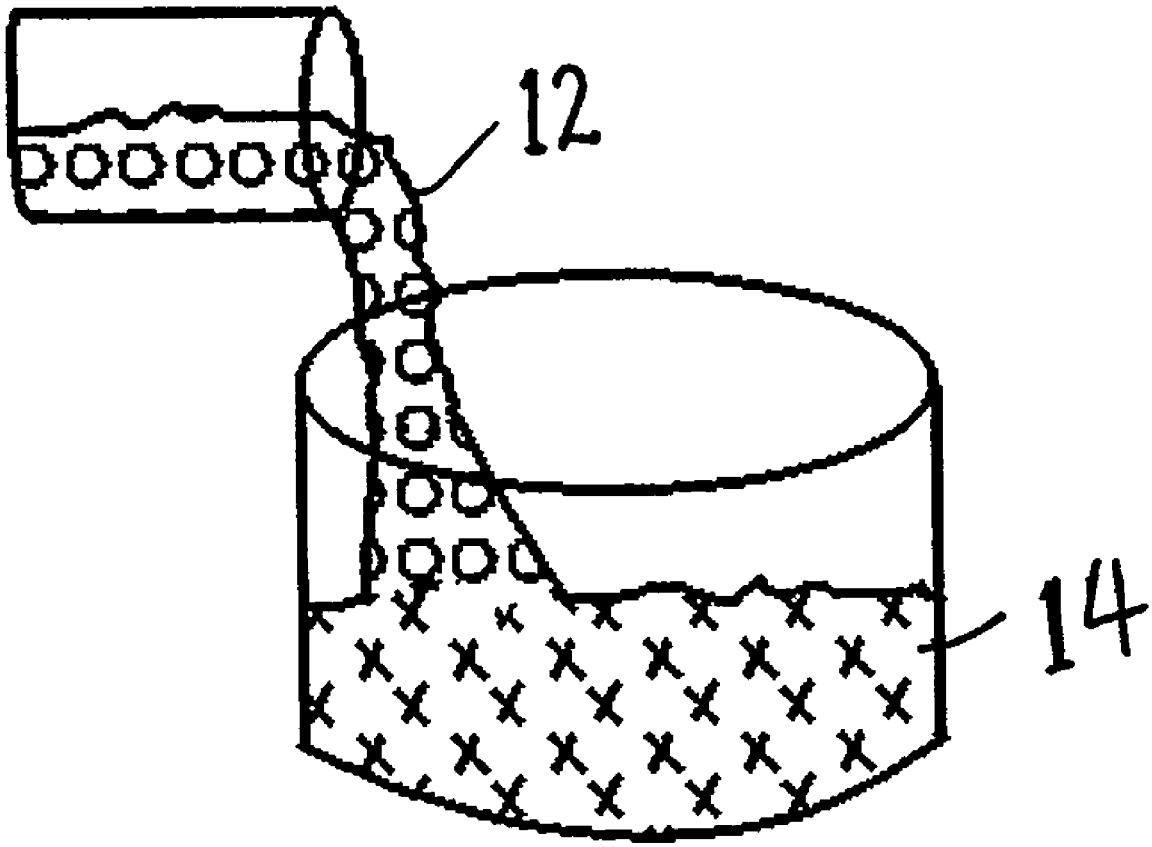
FIG. 3 is a diagrammatic representation the addition of a carrier to a colorant.

As shown in FIG. 3, the carrier 12 is introduced to a colorant 14, which is absorbed by the carrier 12. The core mixture 16 is essentially a mixture of: the carrier 12, such as the rice straw as the fibrous, absorbent material, and the colorant 14. Other materials, ingredients or additives, such as binders, surfactants, emulsifiers, or desiccants, may be incorporated into the core mixture 16 to achieve desired properties, or to increase the performance or properties of the projectile core of the present invention.

The carrier 12 may be ground, granulated, compacted, or otherwise pulverized prior to introduction of the colorant 14. Any method of grinding, compacting, granulating, or pulverizing the carrier 12 is acceptable. The carrier 12 may also be dried to remove moisture. By way of example, the porosity of rice straw may be controlled by grinding and drying. It is possible to produce a core mixture 16 formed from rice straw as a carrier 12, where the void fraction is up to 80% of the volume of the core mixture 16.

The colorant 14 may be introduced to the carrier 12 in any acceptable method whereby an amount of colorant 14 will be absorbed by the carrier 12. For example, where the colorant 14 is a liquid dye, an amount of liquid dye may be introduced to the carrier 12 via soaking the carrier 12 in the liquid dye, dipping the carrier 12 into the liquid dye or a liquid dye bath, spraying the liquid dye onto the carrier 12, or the liquid dye may be injected into the carrier 12, or the liquid dye may be poured into an amount of the carrier 12, thus forming the core mixture 16. The core mixture 16 may be mixed or otherwise blended, such as to produce a substantially uniform distribution of color throughout the core mixture 16. Mixing the carrier 12 and a liquid dye, or other liquid colorant 14, produces a core mixture 16 which is a semi-solid or slurry, that may be molded, shaped, stamped, compacted, or otherwise formed into a predetermined core shape for a projectile core 10 and/or a projectile 18, as described in further detail below. Upon curing the core mixture 16, the projectile core 10 comprises a substantially firm mass that retains the predetermined core shape of the projectile core 10 until impacting a target. In an alternate embodiment, the core mixture 16 is of such a dryness that it may be formed into the substantially firm projectile core 10 without further curing.

Figure 4:
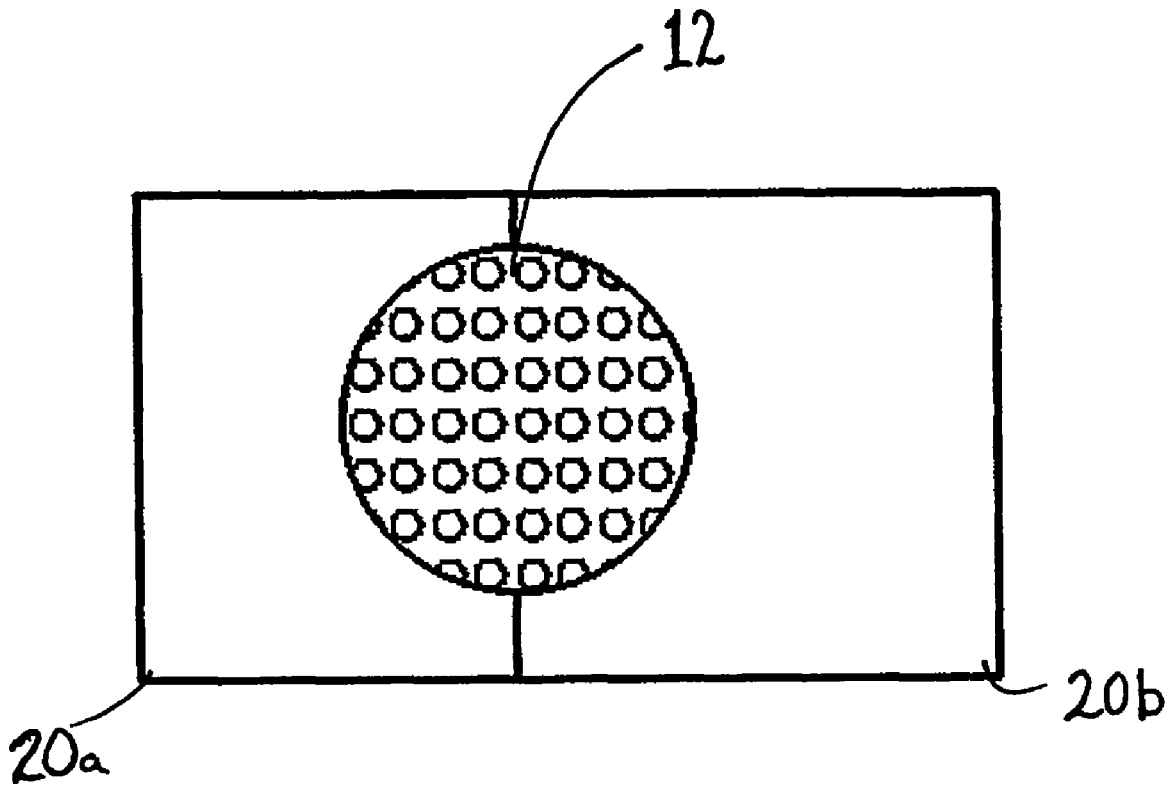
FIG. 4 is a diagrammatic cross sectional view of a molding process for forming a projectile core of the present invention.

In one embodiment, the carrier 12 is ground, granulated, compacted, or pulverized, and then shaped by a mold to form the predetermined core shape of the projectile core 10, prior to the addition of the colorant 14. Alternately, the colorant 14 may be added to the carrier 12 prior to molding or shaping. The carrier 12 or core mixture 14 is formed into the predetermined core shape and size of a projectile 18 by molds, by the use of a press, by stamping, by dies, or any other suitable means. As shown by FIG. 4, the carrier 12 may be placed between first and second mold halves 20*a*, 20*b* forming two halves of a projectile, which are brought together, capturing the carrier 12 within the mold portions 20*a*, 20*b*.

In one embodiment of the invention, the projectile core 10 is made by grinding, granulating, compacting, or pulverizing the carrier 12 into a particulate, granular or powdery substance. Colorant 14, such as a liquid dye, is added to the carrier 12, forming the core mixture 16. Binders such as cellulose, gelatin, plasticizers, various gums, waxes, cellulose derivatives, gelatin, lignin, PVP, PVA and a complex magnesium silicate and lubricants such as metal stearates, fatty alcohols, fatty acids and/or oils, oils, butters, lipids, surfactants, starch, dextrin, sodium alginate, sodium acrylate, polyvinyl pyrrolidone, a monosaccharide or an oligosaccharide such as sucrose, lactose, or acceptable substitutes of these materials, or combinations thereof, may be added to the core mixture 16, to adjust the properties of the core mixture 16. Emulsifiers may also be added to the core mixture 16.

It is appreciated that the colorant 14 may be introduced to the carrier 12 before or after the carrier 12 is formed into the desired final projectile core shape, or may be introduced during each of those steps. Thus, as discussed, the colorant 14 may be added to granulated, ground or pulverized carrier 12 prior to shaping. Alternately, the colorant 14 may be introduced to the carrier 12 after the carrier 12 has been shaped. The carrier 12, previously formed into the predetermined projectile core shape such as a sphere, may be introduced to colorant 14, for a selected period of time, whereby the carrier absorbs the liquid dye. Any acceptable method of incorporating or otherwise introducing the colorant 14 to the carrier 12 may be used, such as spraying, dipping, or using a bath. Furthermore, the liquid dye may be added to the carrier 12 by injecting the colorant 14 into a mold 20 during formation of the projectile core 10.

By way of example, a projectile according to the present invention may be formed by a mold. In this example, mold 20 may have mold portions 20*a*, 20*b*, each mold portion having a cavity 22 that has a contour, defining the final projectile core shape. In the case where the predetermined core shape is a sphere, so that a spherical projectile 18 is formed, each mold portion 20*a*, 20*b* defines half of a sphere. However, it should be readily apparent that the cavities can be formed into any desired projectile shape, so that the core (and resulting projectile) need not be spherical in shape.

Figure 5:
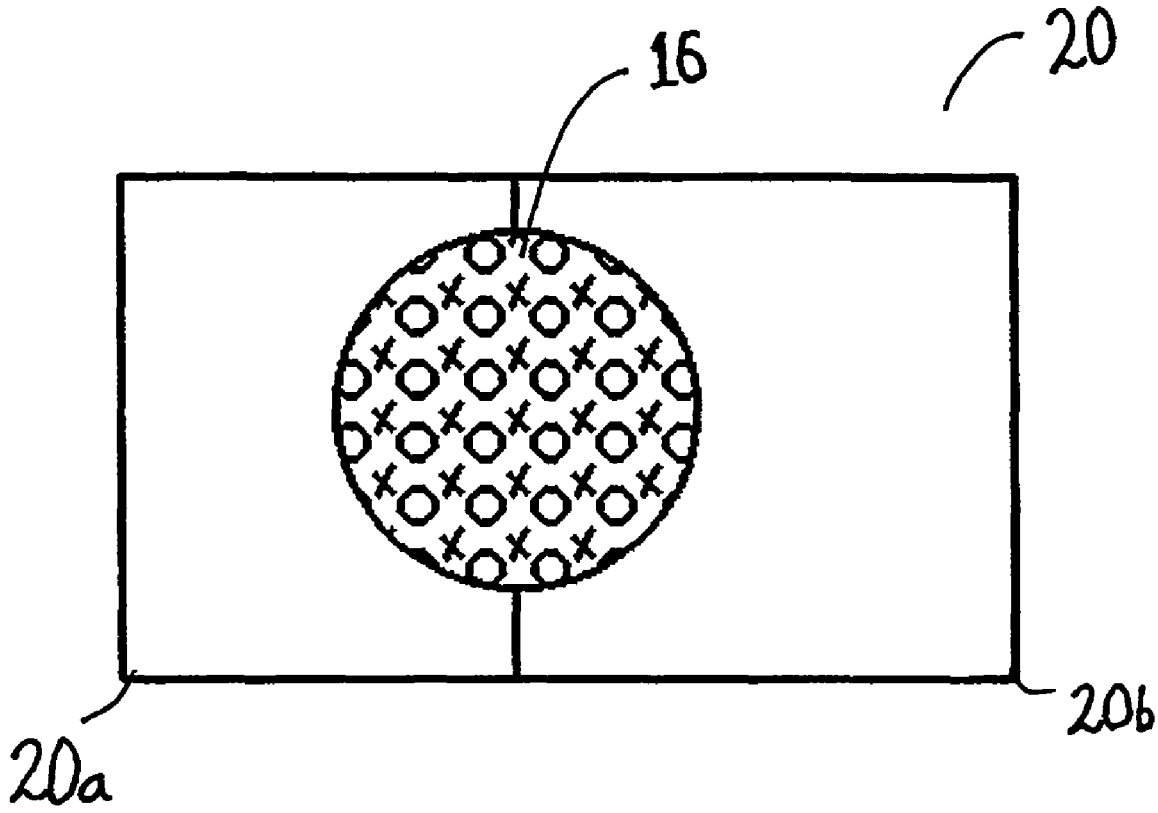
FIG. 5 is a diagrammatic cross sectional view of an alternate molding process for forming a projectile core of the present invention.

The mold portions 20*a*, 20*b* are brought together, capturing a quantity of carrier 12 or core mixture 16 (FIG. 5), within the mold 20 to form a projectile core 10. The mold may then be heated, such as by an external heat source or by utilizing molds that include heating elements, to cure and harden the carrier 12 or core mixture 16 to a desired firmness. Alternately, the shaped projectile core 10 may be removed from the mold, and cured, such as by heating or dg, for example, by baking, heat lamps, or any other acceptable curing means. The mold and core mixture 16 may also be dried by ambient air, to produce a projectile core 10 that is substantially firm. It is appreciated that the projectile core 10 may have portions, such as adjacent the inner portion 36, that remain wet or soggy, particularly where a liquid dye is used as the colorant 14. However, the projectile core 10 of the present invention is cured so that it is substantially firm whereby it retains its overall predetermined core shape, regardless of these inner wet or soggy portions.

It is appreciated that any type of mold capable of shaping the core mixture 16 may be used to produce a projectile core 10 of a predetermined core shape according to the present invention. The carrier 12 or core mixture 16 in any desired state of dryness may be compacted by use of molds, presses and/or dies into the desired shape, density and size.

There may be standard industry sizes that are used to determine the size, weight, or other dimensions of the projectile core 10. Generally, marking projectiles in the sport of paintball, or paintballs, come in sizes ranging from 0.40-0.75 caliber (inches diameter), with the common caliber being 0.68 (0.68 inches diameter), or an approximation of 0.68 caliber. An average paintball weighs between approximately 2.5 g and 4 g. Accordingly, the projectile core 10 may be formed to 0.68 caliber, and the weight may be adjusted to between approximately 2.5 g to 4 g, and preferably 2.8 g to 3.5 g, so that a projectile 18 formed having a projectile core 10 according to the present invention operates with known paintball markers, paintball hoppers, and other equipment.

Figure 7:
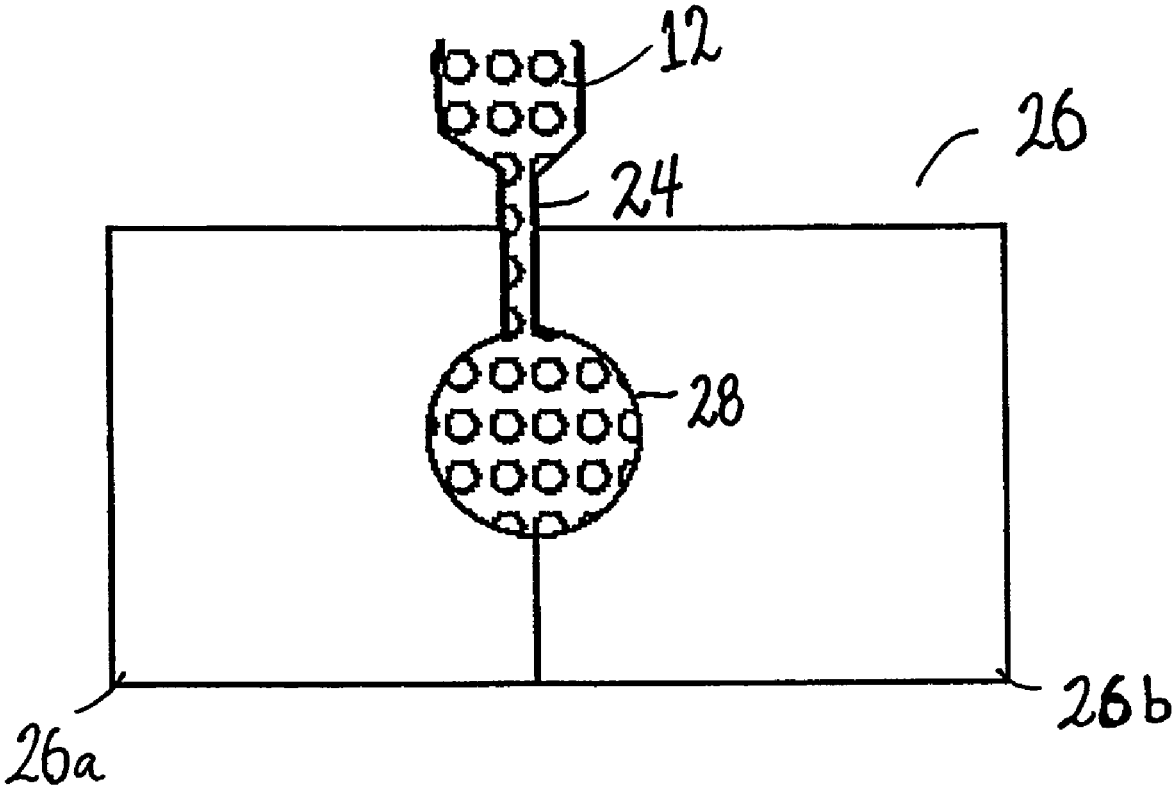
FIG. 7 is a diagrammatic cross sectional view of a further alternate molding process for forming a projectile core of the present invention.

FIG. 7 depicts an alternative method wherein a carrier 12 such as rice straw, or core mixture 16, is injected via a channel 24 into mold 26, having separable portions 26*a*, 26*b*. The mold portions 26*a*, 26*b* are heated thereby drying, to any desired amount, and setting the carrier or core mixture in order to retain the shape defined by the cavity 28 of the mold 26.

Figure 6:
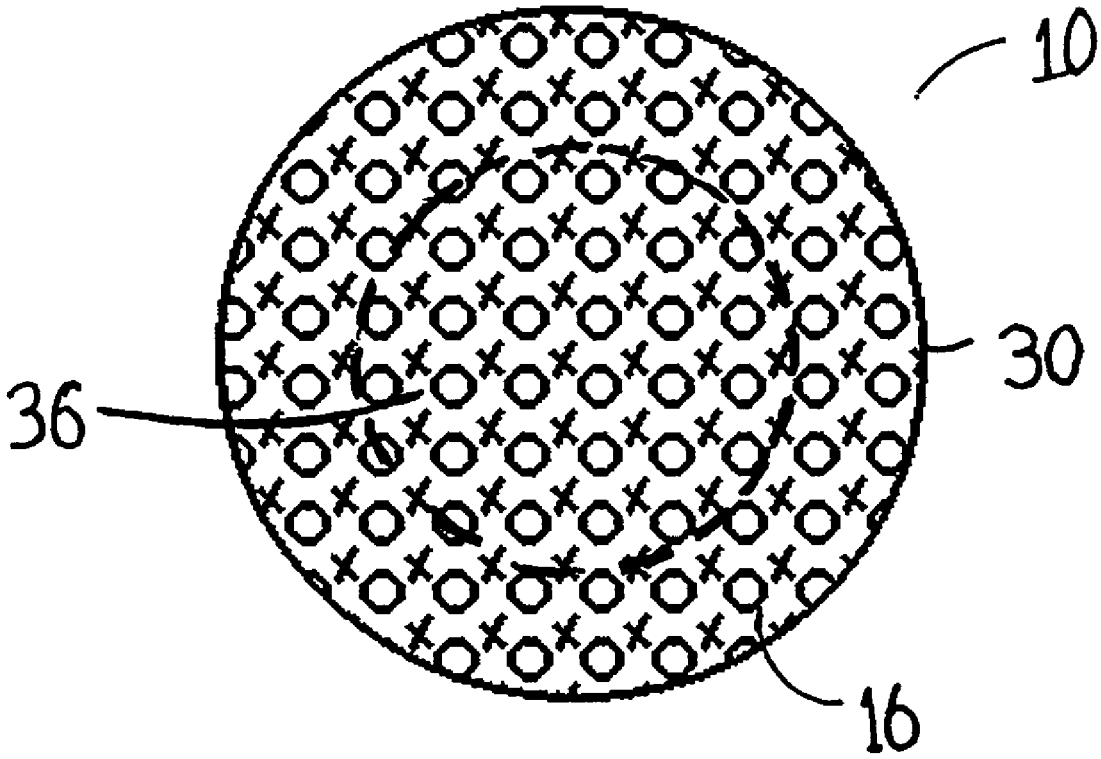
FIG. 6 is a diagrammatic cross sectional view of another embodiment of a projectile core of the present invention.
Figure 8:
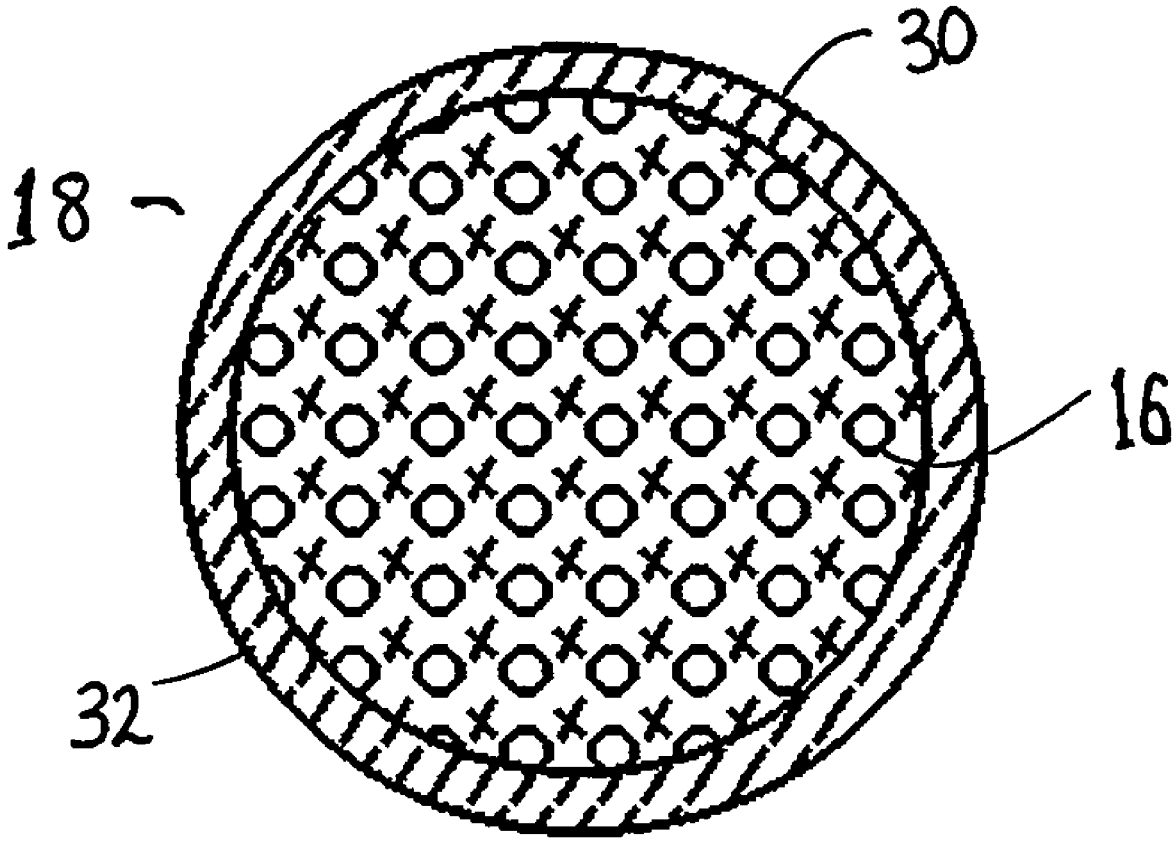
FIG. 8 is a diagrammatic cross sectional view of another embodiment of a projectile core of the present invention.
Figure 9:
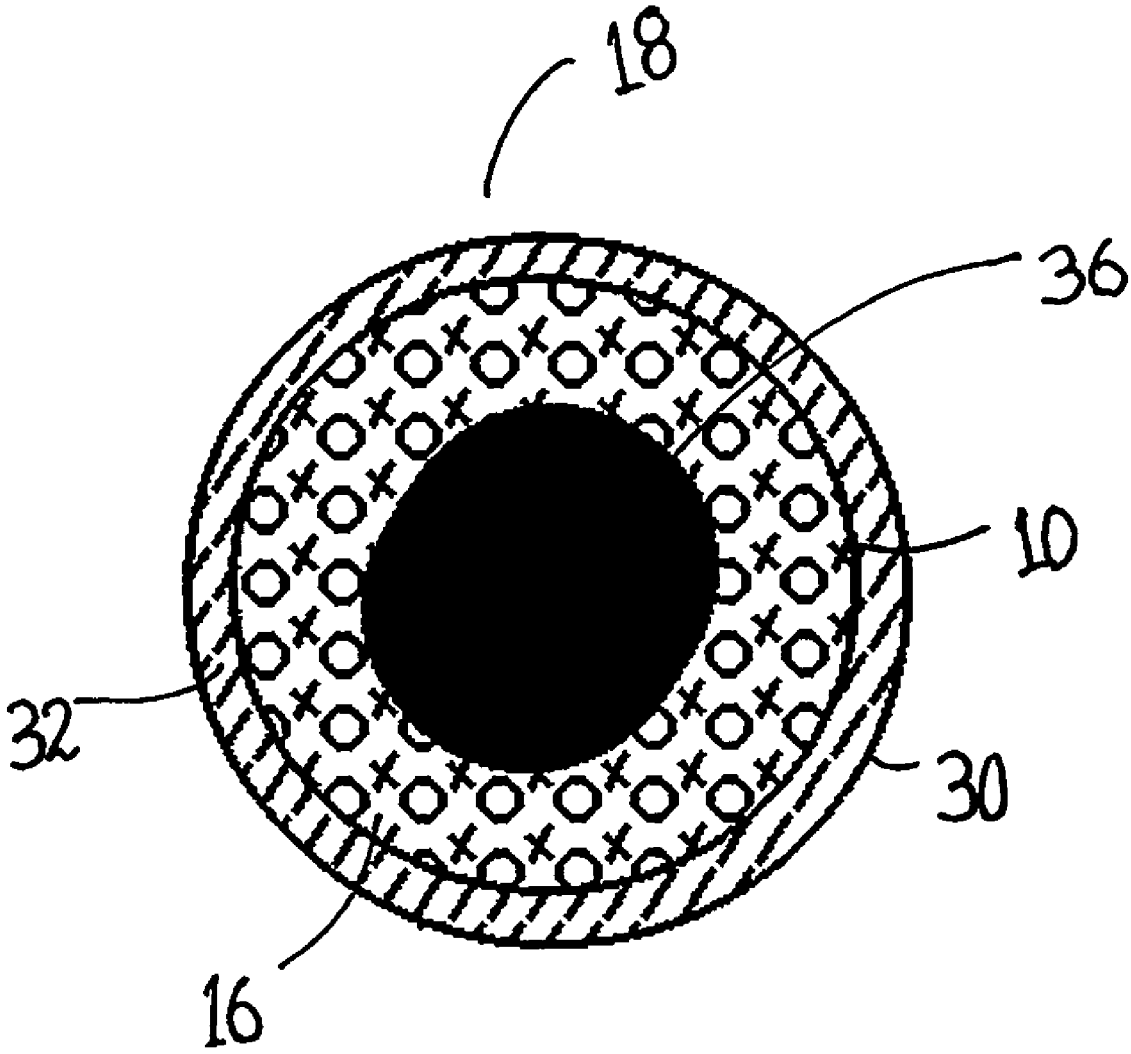
FIG. 9 is a diagrammatic cross sectional view of another embodiment of a projectile core of the present invention.

FIGS. 6, 8, and 9 depict cross sections of various examples of projectiles 18 and projectile cores 10 of the present invention. In addition to any other curing, the application of high temperature to the outside of the projectile core may be used in order to sear, burn, carbonize, or otherwise singe the outer surface 30 of the projectile core 10, forming an outer layer 32 of the projectile core 10 that is hardened, crisp and/or brittle, in comparison to the other portions of the projectile core 10. The outer layer 32 comprises the portion of the projectile core 10 adjacent the outer surface 32 that has hardened in relation to the other portions of the projectile core nearer the center 34 of the projectile core 10. The thickness of the outer layer 32 may be controlled by controlling the time of exposure to heat, the carrier 12 selected, any other ingredients added to the core mixture 16, or other factors.

In one embodiment, depicted in FIG. 9, where high temperature is applied to the outer surface 30 and an outer layer 32 is formed, the inner portion 36 of the projectile core 10 may remain wet, moist, or soggy. Thus, when a projectile 18 formed having such a projectile core 10 is shot from a projectile marker and impacts a target, the outer layer 32 will disintegrate, disperse, burst and/or crack upon impact, and the inner portion 36 of the projectile core 10, which is a moist, colored mass, will hit the target producing a "splat," marking the target.

As shown in FIG. 8, the core mixture 16 that has been formed into the desired shape of a projectile 18 is cured until a substantially firm projectile core 10 is formed. In another embodiment of the present invention, the projectile core 10, once formed, may be cured until the projectile core 10 is essentially dry. In this case, essentially dry does not mean completely free of all moisture, but instead refers to a state where the core is no longer wet or soggy. The projectile core 10 may also be cured until it reaches a chalky or powdery state throughout. Upon impact, such a projectile core 10 will at least partially disintegrate or disperse, producing a dry powder "splat" marling the target.

Figure 10:
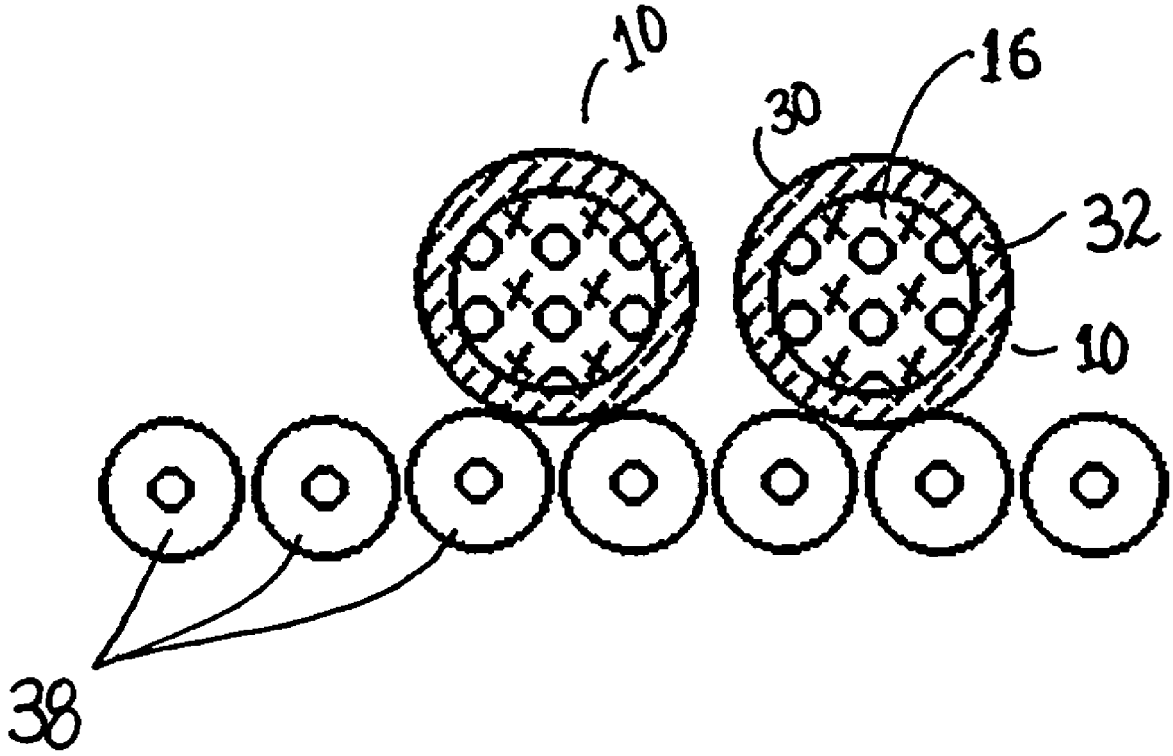
FIG. 10 is a diagrammatic cross sectional view of a curing process for forming a projectile core of the present invention.

The projectile core 10 may also be heat treated such as by hot rollers 38, shown in FIG. 10. The projectile core 10 is turned on the hot rollers 38 for a selected time at a selected temperature, until the outer surface 30 of the projectile core 10 is singed, burned, or carbonized, forming an outer layer 32 as previously discussed. The outer surface 30 of the projectile core 10 will burn, singe, bake and/or char while turned on the hot rollers 38. The longer the projectile core 10 is in contact with the hot rollers 38, the thicker the outer layer 32. The projectile core 10 is turned on the hot rollers 38 until a desired outer layer 32 thickness T is achieved.

In an alternate embodiment, the core mixture 14, once formed into the desired projectile core 10 shape, is freeze dried, by rapid freezing and drying. This step removes moisture, and produces a hardened projectile core 10 impregnated with liquid dye 12. The freeze dried projectile core 10 may then be subjected to heat, producing an outer layer 32 formed such as by heating, as described above.

It is appreciated that, once the outer layer 32 has been formed, the projectile core 10 may thus be considered a finished and useable projectile 18, and is therefore ready for use. Thus, a projectile core 10 of the present invention need not be sealed or coated with gelatin or starch compounds, as there is no need for a coating in order to retain the shape of the projectile core 10.

Figure 11:
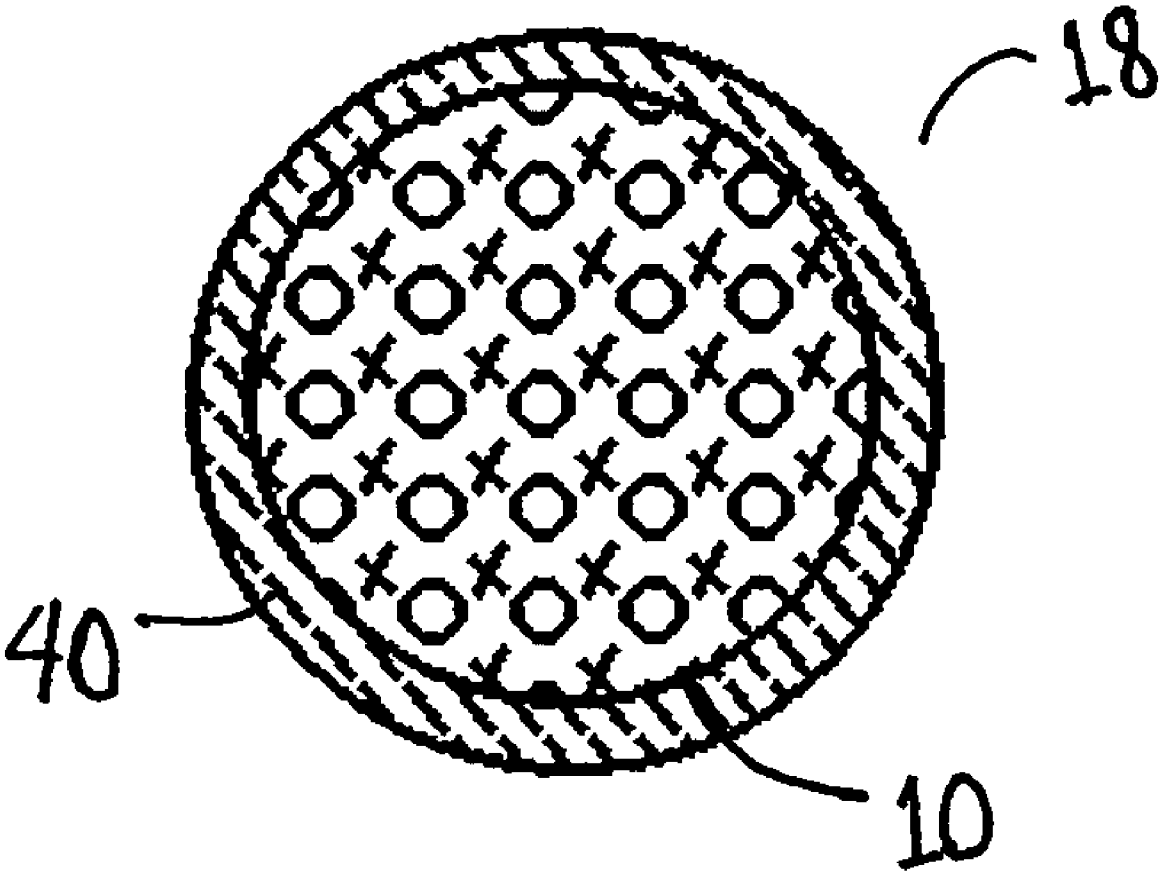
FIG. 11 is a diagrammatic cross sectional view of an embodiment of a projectile of the present invention.

However, it may be desirable to coat the projectile core 10, as shown in FIG. 11, with an outer coating 40, which may act as a sealant, protectant, or simply to present a finished cosmetic appearance of the projectile. Gelatin compositions, starch compositions, wax compositions, or plastic compositions may be used in forming the outer coating 40. For example, outer coating 40 can be made from hydrophilic colloidal materials such as, but not limited to, gelatin, albumin, gum arabic, alginate, casein, agar or pectins, acceptable substitutes, or combinations of those materials. Outer coating 40 could also be made from a synthetic organic compound such as, but not limited to, polystyrene, polypropylene, polyethylene, polycarbonate, polyamide, polysulfane or polyvinylchloride.

Preferably, the outer coating 40 is formed from albumin, or a mixture of albumin and other suitable materials, which is applied to the projectile core 10. The outer coating 40 may be applied in any acceptable manner, such as through soaking or dipping in a bath, spraying, and/or rollers. The outer coating 40 will conform to the predetermined core shape of the projectile core 10.

The outer coating 40 is capable of protecting the projectile core 10 until the projectile 18 is fired and impacts a target. The outer coating 40 provides resistance to projectile core breakage prior to being fired from a projectile marker, and impacting a target. Unlike known projectiles formed as the joining of two gelatin or starch sphere halves, the coated projectile 18 of the present invention can be formed having no seam to disturb the projectiles flight when fired at a target.

Several properties of the projectile core 10 of the present invention can be controlled and manipulated in order to alter the characteristics, makeup and performance of a projectile formed utilizing the projectile core 10 of the present invention. For example, the degree the core material 12 is ground, pulverized, compacted, or granulated, can be controlled to alter the particle size and/or porosity. The degree the projectile core 10 is compacted during formation can be controlled in order to alter the density. Where the carrier 12 is molded prior to the addition of colorant 14, the denser the core, the less the colorant 14 will permeate through the carrier 12. The viscosity, flexibility, dampness, dryness, or other properties, of the inner portion 36 can also be controlled in order to alter the amount of amount of wet or soggy "splatter" when a target is struck with the projectile 18. The amount the carrier 12 and colorant 14 are dried may also be controlled. The granular size of the particles of carrier 12, such as rice straw, can be controlled to alter the absorption properties, and therefore the final weight of the projectile formed with the core of the present invention.

Because of the various properties that can be easily and efficiently controlled when making a projectile core of the present invention, it is appreciated that a projectile formed according to the present invention can be of any size and weight required by a projectile marker.

Powder Core

Figure 12:
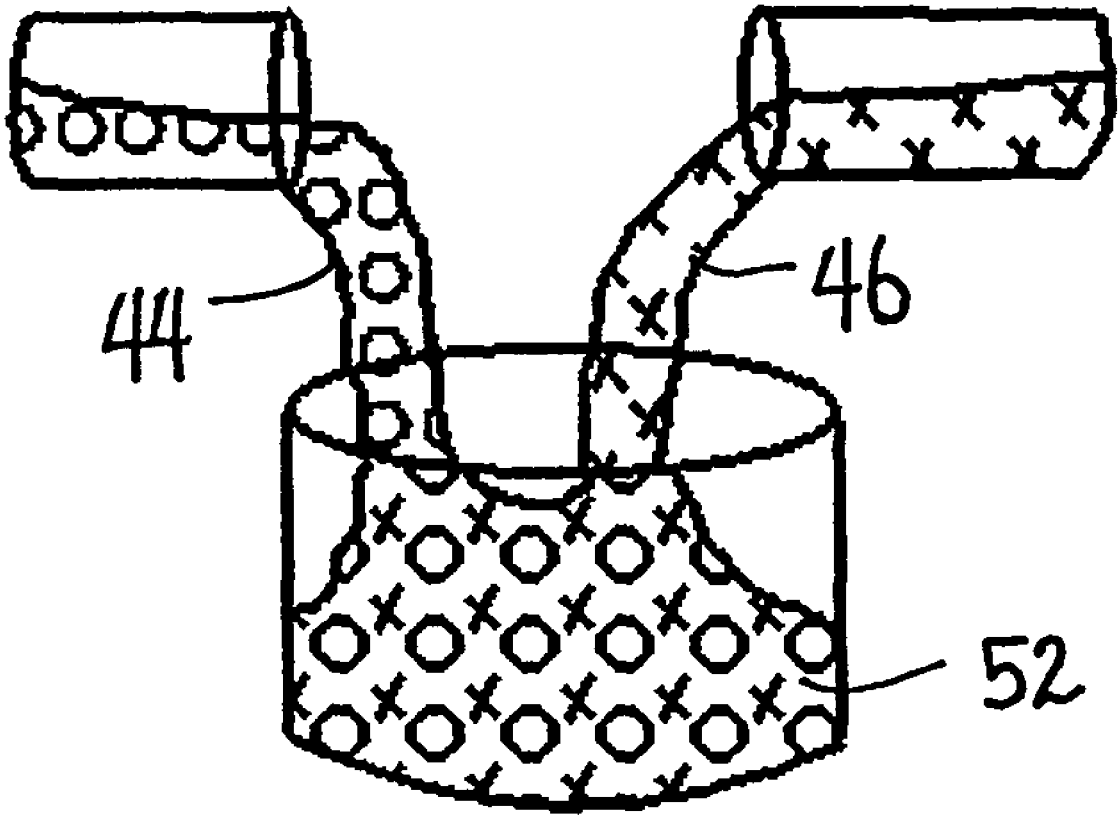
FIG. 12 is a schematic representation of a mixture of materials to form an alternate embodiment of a projectile core of the present invention.
Figure 13:
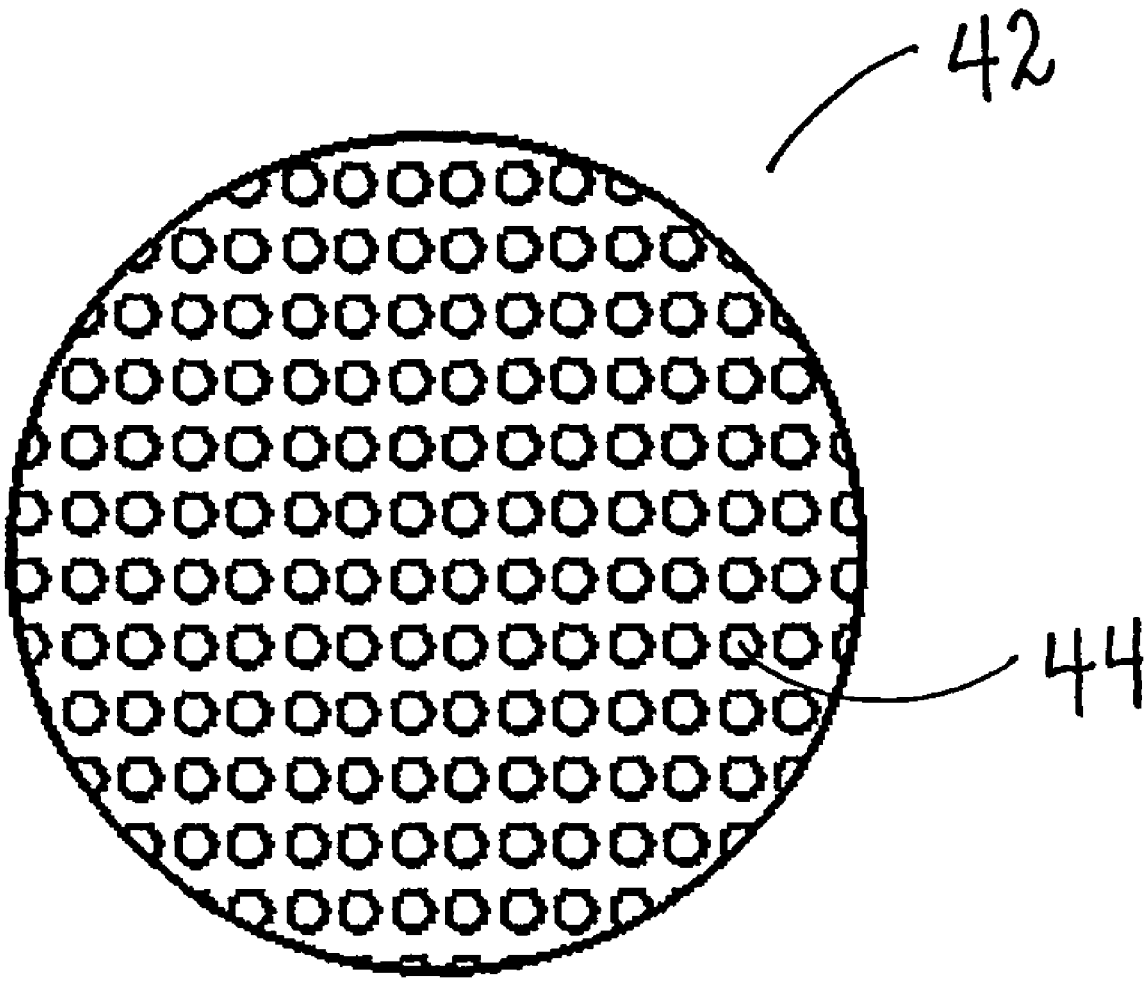
FIG. 13 is a diagrammatic cross sectional view of an alternate embodiment of a projectile core of the present invention.

In a further embodiment of the present invention, FIGS. 12 and 13 depict a projectile core 42 comprising a base powder material 44 as the carrier. Examples of acceptable base powder materials 44 include, but are in no way limited to, calcium carbonate, chalk (calcite), zinc oxide or talc, fullers earth, kaolin, starch, gums, colloidal silica, bismuth oxychloride, titanated mica, silica, polymethylmethacrylate, micronized TEFLON, boron nitride, acrylate copolymers, aluminum silicate, aluminum starch octenylsuccinate, bentonite, calcium silicate, cellulose, corn starch, diatomaceous earth, fuller's earth, glyceryl starch, hectorite, hydrated silica, kaolin, magnesium aluminum silicate, magnesium trisilicate, maltodextrin, montmorillonite, microcrystalline cellulose, rice starch, mica, titanium dioxide, zinc laurate, zinc myristate, zinc rononate, alumina, attapulgite, calcium silicate, dextran, nylon, silica silylate, silk powder, nylon spheres, ceramic spheres, synthetic polymer powders, powdered natural organic compounds such as ground solid algaes, encapsulated and unencapsulated grain starches, mixtures or combinations of any of these materials, or acceptable substitutes. The base powder material 44 may have absorbent properties, adsorbent properties, or combinations of each of these properties.

A colorant 46 is preferably added to the base powder material 44. A binder which may be a solid, semi-solid, or liquid, can also be added to the base powder material to assist in molding the material into the desired shape. In some cases, it is appreciated that the base powder material 44 may have a natural color, even without the addition of a colorant. In that case, the base powder material 44 may be mixed with a suitable binder, and formed into a projectile core according to the present invention.

The colorant may take the form of liquid dye, as discussed above, or make take the form of a pigment. For example, lake dyes, micas or pearls, iron oxides, titanium oxides, calcium carbonates, treated pigments, and mixtures thereof, may be mixed with the base powder to form a colored mixture for use as the core mixture. Organic pigments include aromatic dyes such as azo, indigo, triphenylmethane, anthraquinone, and xanthine dyes which are designated as D&C and FD&C blues, browns, greens, oranges, reds, yellows and so forth. Organic pigments also include insoluble metallic salts of certified color additives, lakes. Inorganic pigments include iron oxides, ultramarines, chromium, chromium hydroxide colors and mixtures of these materials. All of these would be considered suitable colorants.

In order to form the core, any of the methods discussed above may be used. Further descriptions of acceptable methods follow. In one method, the base powder material 44 is selected so as to be compactable in its dry state. Any conventional molding operation case be used to form the projectile core. For example, the base powder material 44 could be poured into a first mold cavity and then compacted with a second mold cavity into the predetermined core shape. The pressure applied by the mold compresses the base powder material 44 and any added binder or excipients, into the substantially firm projectile core. Depending on the compressibility of the selected base powder material 44, an outer coating may or may not be needed.

The base powder material 44 (with or without added ingredients) or core mixture 52 may be mixed with a suitable binder. The base powder material 44 (with or without added ingredients) or core mixture 52 may then be injected or otherwise channeled into a mold cavity where the material is formed into a predetermined core shape. The base powder material 44 (with or without added ingredients) or core mixture 52 is then cured, as described above, until it is substantially firm.

Figure 14:
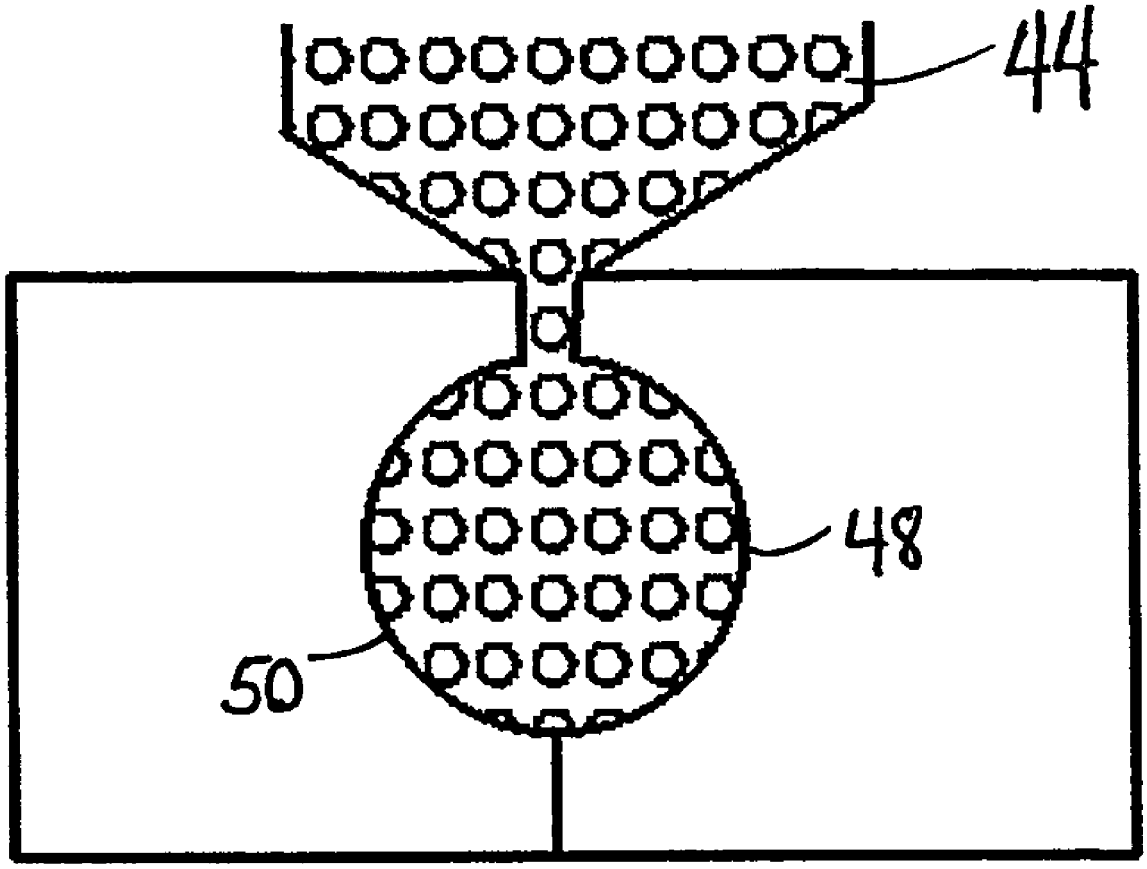
FIG. 14 is a diagrammatic cross sectional view of a molding process to form an alternate embodiment of a projectile core of the present invention.

A first method to form a projectile core 42 from a base powder material 44, shown in FIG. 14, utilizes a base powder material 44 that is compactable in its dry state. Any conventional molding operation can be used to form the projectile core 42. The base powder material can be poured into a first mold cavity 48 and then compacted with a second mold cavity 50 to form the desired shape.

Figure 15:
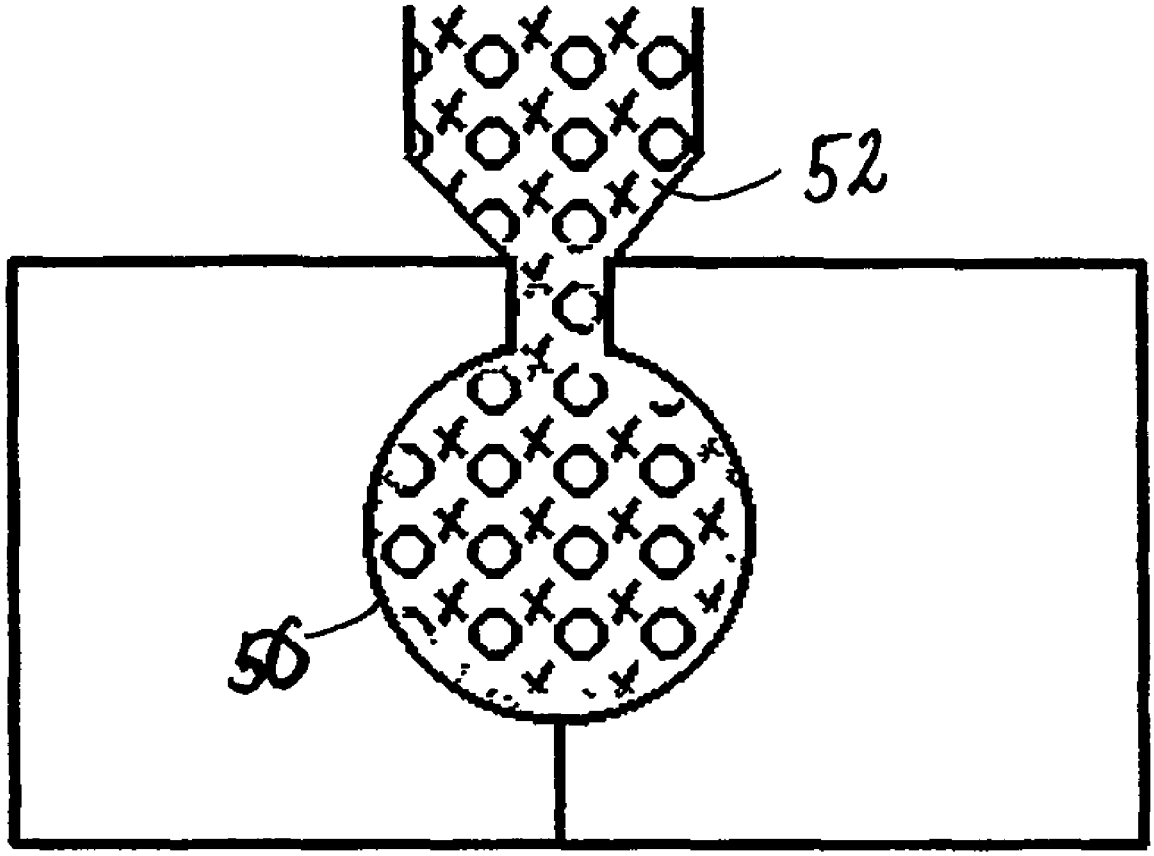
FIG. 15 is a diagrammatic cross sectional view of a molding process to form an alternate embodiment of a projectile core of the present invention.
Figure 16:
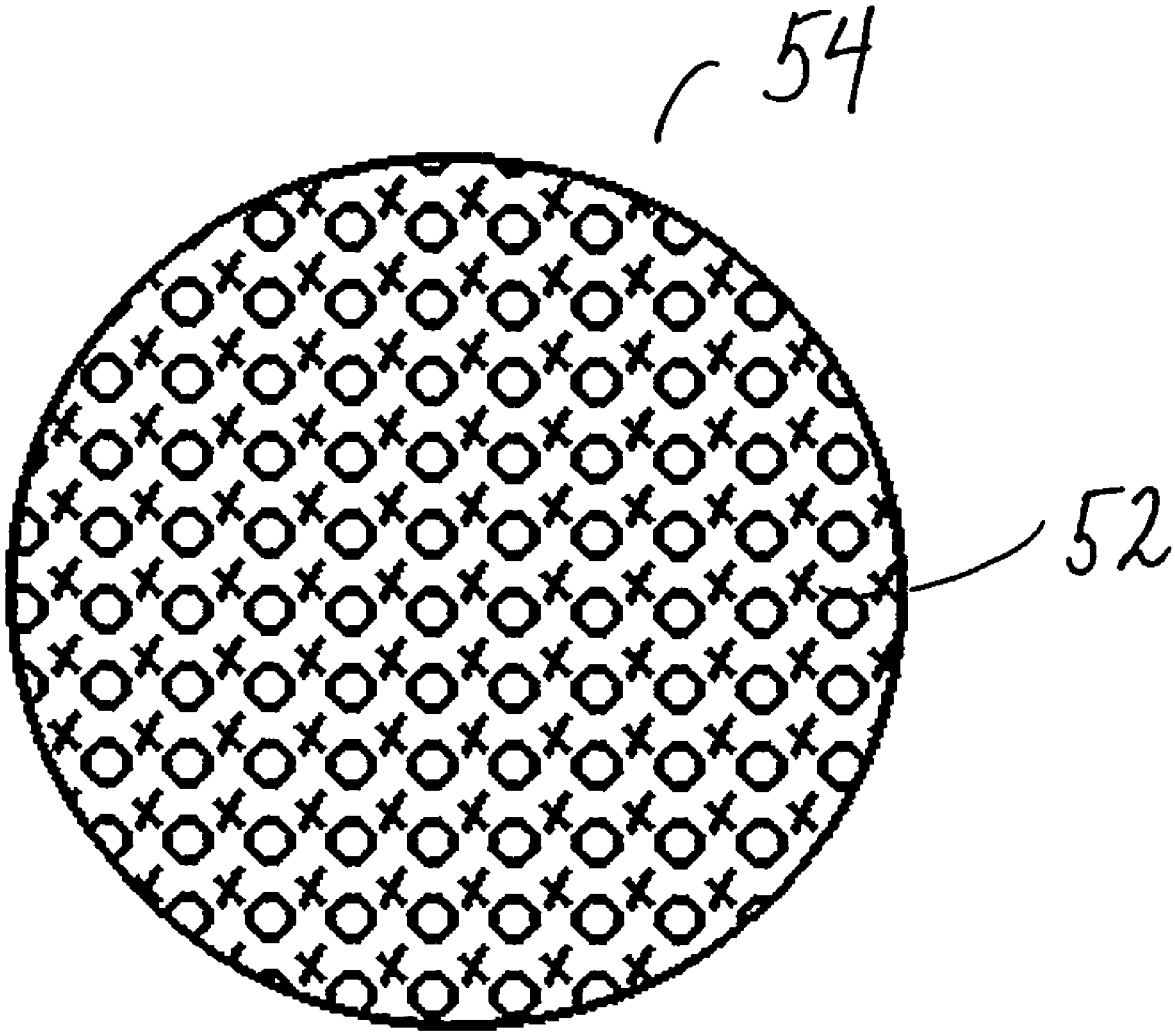
FIG. 16 is a diagrammatic cross sectional view of another embodiment of a projectile of the present invention.

Another method of forming the base powder material 44 projectile core is by the preparation of a damp core mixture 52 of base powder material 44 combined with a colorant 46. In this embodiment, the core mixture 52 may be further mixed with a suitable binding agent to form a pourable, moldable core mixture 52. As shown in FIG. 15, this core mixture 52 is then injected or directed into a mold cavity 56 where the core mixture 52 forms the desired shape. The molded projectile 54 (FIG. 16) is allowed to dry or cure by ambient or heated air. Alternatively, the mold can be heated to cause the mixture to set. It is also contemplated that a drying agent can be added to the core mixture 52, e.g., silica, calcium chloride, etc.

The projectile core formed with a base powder material 44 may be coated with an outer coating, as discussed above.

It is appreciated that, once a cellulosic material is ground, granulated, or pulverized, it may comprise a powdery substance. Thus, "powder" as used herein therefore encompasses the cellulosic materials that have been dried and ground into powder, previously discussed, as well the base powder material discussed.

It is appreciated that those skilled in the art would be readily capable of selecting suitable materials for the preparation of the projectile core and projectile of the present invention based on the present disclosure.

The projectile core and projectile described herein are most preferably intended for use as a paintball in the sport of paintball. Marling projectiles such as paintballs must maintain their shape and integrity during firing from, for example, compressed gas powered paintball markers. Such paintballs then must at least partially disintegrate or disperse upon impact with a target at impact velocity, namely, the speed at which the paintball strikes a target such as a human paintball sport player equipped with the appropriate protective gear. Known paintballs that are essentially capsules filled with liquid must break, rupture, or other disperse the liquid dye upon impact at ranges of between 25 to 300 feet, with the ideal range being between 50-100 feet. Accordingly, it is appreciated that the projectile core and projectile of the present invention are preferably formed to meet the parameters necessary for use in the sport of paintball.

Paintball markers may have a muzzle speed of between approximately 175 to 500 fps, with the preferred muzzle velocity being approximately between 250-350 fps. In paintball sport competitions, the velocity at which a paintball marker fires a paintball from its barrel is sometimes limited to 300 fps or less to protect the paintball sport players from harm. The impact velocity of a paintball, the speed at which the marking projectile hits a target, for example, a human paintball sport player wearing the appropriate protective gear, is generally less than the muzzle velocity, but greater than 50 fps to be effective. The projectile core and projectile of the present invention are preferably formed to retain the predetermined core shape under the conditions of the muzzle velocities described herein, and at least partially disintegrate or disperse upon impacting a target at the described impact velocity, in order to present a colored "mark" or "splat" comparable to the mark made upon impact of known liquid dye filled paintballs.

One of the benefits that can be provided by the present invention is dimensional stability. Using the present invention, the new projectile core and/or projectile can be made to hold a favorable shape for projectile flight more closely than existing projectiles because it is shaped by the projectile core, and not the shell or coating. An existing projectile is an elastic material filled with a liquid, that is deformable. This means that during shipment and storage an existing projectile can and will change shape. The change in dimension will adversely effect loading and flight of the ball. Breakage is also an issue. A projectile made according to the present invention is substantially firm and will resist deformation under transport and storage. The substantially firm shape is produced during manufacturing and can be formed in a consistent way with existing machinery.

Another benefit of the present invention is the ability to control carrier characteristics, core mixture characteristics, and projectile shape. During manufacture, fibrous materials can be added to the mixture of solids. By changing the type, length, thickness, weave and/or amount of these fibers the strength of the projectile and resistance to breakage can be controlled. The shape of the projectile can also be controlled using similar methods.

It is understood that the present invention is not limited to the particular embodiments shown and described herein, but that various changes and modifications may be made without departing from the scope and spirit of the invention.

What is claimed is:

1. A projectile, comprising:

a substantially spherical core including a carrier and a colorant mixed together and formed into a substantially firm predetermined core shape that is retained by the projectile core prior to impact of the projectile core upon a target; and, a generally uniform coating bonded to and enveloping the core, the coating conforming to the shape of the core and providing resistance against breakage of the projectile core prior to impact of the projectile core;

at least a portion of the coating and core adapted to disintegrate or disperse upon impact with a target.

2. The projectile core of claim 1, wherein the colorant is at least one of a pigment and a liquid dye.

3. The projectile core of claim 1, wherein the carrier comprises one of a fibrous, absorbent material and a powder.

4. The projectile core of claim 1, wherein the carrier comprises a plant fiber.

5. The projectile core of claim 1, wherein the carrier comprises a cellulosic material.

6. The projectile core of claim 5, wherein the cellulosic material comprises rice straw.

7. The projectile core of claim 1, wherein the carrier comprises a powder.

8. A projectile for marking a target, comprising:

a substantially spherical projectile core comprising a carrier and a colorant mixed together and formed into a substantially firm predetermined core shape that is retained by the projectile core prior to impact of the projectile core upon a target; and a generally uniform coating bonded to and enveloping the core, the coating conforming to the shape of the core and providing resistance against breakage of the projectile core prior to impact of the projectile core.

9. The projectile core of claim 8, wherein the colorant is one of a pigment and a liquid dye.

10. The projectile core of claim 8, wherein at least a portion of the projectile core is adapted to disintegrate or disperse upon impact with a target.

11. The projectile core of claim 8, wherein the carrier comprises at least one of a fibrous, absorbent material and a powder.

12. The projectile core of claim 8, wherein the carrier comprises a plant fiber.

13. The projectile core of claim 8, wherein the carrier comprises a cellulosic material.

14. The projectile core of claim 13, wherein the cellulosic material comprises rice straw.

15. The projectile core of claim 1, wherein the carrier comprises a powder.

16. The projectile of claim 1, wherein the generally uniform coating comprises a wax coating.

17. The projectile of claim 8, wherein the generally uniform coating comprises a wax coating.

18. The projectile of claim 1, wherein the projectile is a paintball.

19. The projectile of claim 8, wherein the projectile is a paintball.

20. A paintball, comprising:

a substantially spherical core comprising a powder formed into a substantially firm predetermined core shape that is retained by the paintball core prior to impact of the core upon a target; and a wax coating enveloping the core, the wax coating conforming to the shape of the paintball core and providing resistance against breakage of the paintball core prior to impact;

at least a portion of the wax coating and paintball core adapted to disintegrate or disperse upon impact with the target.

21. The paintball of claim 20, wherein the paintball is approximately 0.4- 0.75 caliber in size.

* * * * *